US006694661B1

(12) United States Patent
Langford

(10) Patent No.: US 6,694,661 B1
(45) Date of Patent: Feb. 24, 2004

(54) TREE STAND RESTING SYSTEM

(76) Inventor: Harley C. Langford, 4601 Charro La., Plant City, FL (US) 33565-3607

( * ) Notice: Subject to any disclaimer, the term of this patent is extended or adjusted under 35 U.S.C. 154(b) by 0 days.

(21) Appl. No.: 10/229,420

(22) Filed: Aug. 28, 2002

(51) Int. Cl.[7] ..... F41A 29/00; F41A 31/00
(52) U.S. Cl. ..... 42/94; 89/37.04
(58) Field of Search ..... 42/94; 89/37.04

(56) References Cited

U.S. PATENT DOCUMENTS 4,095,768 A * 6/1978 Chasen ..... 248/290.1
5,491,920 A * 2/1996 McCullers ..... 42/94
5,685,103 A * 11/1997 Wiggins ..... 42/94
5,723,808 A * 3/1998 Devall ..... 89/37.04
5,769,372 A * 6/1998 Klosterman ..... 248/219.4
5,857,651 A * 1/1999 Kunevicius ..... 248/230.8
6,295,976 B1 * 10/2001 Runde ..... 124/86
6,478,272 B1 * 11/2002 McKinsey et al. ..... 248/216.1

* cited by examiner

*Primary Examiner*—Michael J. Carone
*Assistant Examiner*—M. Thomson
(74) *Attorney, Agent, or Firm*—Edward P. Dukiewicz

(57) ABSTRACT

A tree stand rest system comprises a gun and a tree. A mounting bracket is couplable to the tree. Tree stand-offs are adapted to rest against the tree. The top end has a tree leveling screw adapted to be adjusted to various pitches of the top. A strap attachment ring has an aperture. A strap around the tree has a hook. A pivot arm extending generally horizontally has a vertical cylindrical pivotable end rotatably coupled to a pivot arm axle. A pivot arm support cable has a tree end coupled to the mounting bracket and a pivot arm end coupled to the distal end of the pivot arm. A cylindrical support leg extends vertically downward. A cradle is formed in the support leg.

5 Claims, 5 Drawing Sheets

TREE STAND RESTING SYSTEM

BACKGROUND OF THE INVENTION

1. Field of the Invention

The present invention relates to a tree stand resting system and more particularly pertains to providing a pivoting and leveling above-the-head mounted rest for weapons and the like.

2. Description of the Prior Art

The use of tree stands and hunting aids of known designs and configurations is known in the prior art. More specifically, tree stands and hunting aids of known designs and configurations previously devised and utilized for the purpose of providing a rest for weapons and the like for use by outdoors men through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,723,808 to Devall issued Mar. 3, 1998, discloses an adjustable rest. U.S. Pat. No. 5,491,920 issued Feb. 20, 1996, to McCullers discloses a firearm support that is attached to a tree and mounted above a user's head. U.S. Pat. No. 5,685,103 to Wiggins issued Nov. 11, 1997, discloses a gun support. U.S. Pat. No. 4,823,673 to Downing issued Apr. 25, 1989, discloses a swivel adapter for a gun holder. U.S. Pat. No. 5,974,719 to Simonek issued Nov. 2, 1999, discloses a gun support. U.S. Pat. No. 5,491,919 issued Feb. 20, 1996, to Rather et al. discloses a multi-functional variable position rifle and camera mount. U.S. Pat. No. 6,276,087 issued Aug. 21, 2001, to Singletary discloses a portable firearm support device. U.S. Pat. No. 5,930,931 issued Aug. 3, 1999, to Watson discloses an adjustable gun rest. Finally, U.S. Pat. No. 5,481,817 issued Jan. 9, 1996, to Parker discloses a firearm support.

While these devices fulfill their respective, particular objectives and requirements, the aforementioned patents do not describe a tree stand resting system that allows providing a pivoting and leveling above-the-head mounted rest for weapons and the like.

In this respect, the tree stand resting system according to the present invention substantially departs from the conventional concepts and designs of the prior art, and in doing so provides an apparatus primarily developed for the purpose of providing a pivoting and leveling above-the-head mounted rest for weapons and the like.

Therefore, it can be appreciated that there exists a continuing need for a new and improved tree stand resting system which can be used for providing a pivoting and leveling above-the-head mounted rest for weapons and the like. In this regard, the present invention substantially fulfills this need.

SUMMARY OF THE INVENTION

In view of the foregoing disadvantages inherent in the known types of tree stands and hunting aids of known designs and configurations now present in the prior art, the present invention provides an improved tree stand resting system. As such, the general purpose of the present invention, which will be described subsequently in greater detail, is to provide a new and improved tree stand resting system and method which has all the advantages of the prior art and none of the disadvantages.

To attain this, the present invention essentially comprises a gun. The gun has a stock and a barrel. A tree is adapted to hold a tree stand at a first height. A mounting bracket is provided. The mounting bracket is coupled to the tree at a second height. The second height is greater than the first height. The mounting bracket has a top end and a bottom end. A middle portion is provided between the top and bottom ends. The middle portion has a strap attachment ring. The ring has an aperture. The bottom end has tree stand-offs. The tree stand-offs are adapted to rest against the tree. The tree stand-offs further have a pivot arm axle. The axle has a horizontal portion and a vertical portion. The top end has a tree leveling screw. The tree leveling screw is adapted to be adjusted to various pitches of the top end. A pivot arm support cable axle is provided. A nylon strap is provided next. The strap is coupled around the tree at the second height. The strap further has a hook. The hook has a first end. The first end is coupled to the strap. The hook also has a second end. The second end is coupled into the strap attachment ring. Next, a cylindrical telescoping pivot arm is provided. The pivot arm extends generally horizontally. The pivot arm has a first portion. The first portion has a vertical cylindrical pivotable end. The pivotable end is rotatably coupled to the horizontal portion of the pivot arm axle with a bushing. The pivot arm has a second portion. The second portion adjustably telescopes within the first portion and is held in place with a first tightening knob. The second portion of the pivot arm has a distal end. Also provided is a pivot arm support cable. The pivot arm support cable has a tree end. The tree end is coupled to the pivot arm support cable axle of the mounting bracket by means of a bushing. A pivot arm end is coupled to the distal end of the pivot arm adapted to give the pivot arm horizontal support. Further provided is a cylindrical support leg. The support leg extends vertically downward with a top and a bottom. The cylindrical support leg is slidably positionable on the second portion of the pivot arm. The support leg is adapted to be held in place by a second tightening knob. Provided last is a gun cradle. The gun cradle has an upper vertical extent, a hooked portion and a lower handle extent. The upper vertical extent is adapted to telescope into the bottom end of the support leg and is adjusted to a proper height and held in place with a third tightening knob. The hooked portion is adapted to receive the stock of the gun for resting purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tree stand resting system which has all of the advantages of the prior art tree stands and hunting aids of known designs and configurations and none of the disadvantages.

It is another object of the present invention to provide a new and improved tree stand resting system which may be easily and efficiently manufactured and marketed.

It is further an object of the present invention to provide a new and improved tree stand resting system which is of durable and reliable constructions.

An even further object of the present invention is to provide a new and improved tree stand resting system which is susceptible of a low cost of manufacture with regard to both materials and labor, and which accordingly is then susceptible of low prices of sale to the consuming public, thereby making such tree stand resting system economically available to the buying public.

Even still another object of the present invention is to provide a tree stand resting system for providing a pivoting and leveling above-the-head mounted rest for weapons and the like.

Lastly, it is an object of the present invention to provide a new and improved tree stand rest system comprising a gun and a tree. A mounting bracket is provided. The bracket is couplable to the tree. Tree stand-offs are provided. The tree stand-offs are adapted to rest against the tree. The top end has a tree leveling screw. The screw is adapted to be adjusted to various pitches of the top. A strap attachment ring with an aperture is provided. A strap is provided around the tree with a hook. A pivot arm extends generally horizontally. A vertical cylindrical pivotable end is rotatably coupled to a pivot arm axle. A pivot arm support cable has a tree end coupled to the mounting bracket and a pivot arm end coupled to the distal end of the pivot arm. Also provided is a cylindrical support leg extending downward vertically. Lastly, a cradle is formed in the support leg.

These together with other objects of the invention, along with the various features of novelty which characterize the invention, are pointed out with particularity in the claims annexed to and forming a part of this disclosure. For a better understanding of the invention, its operating advantages and the the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
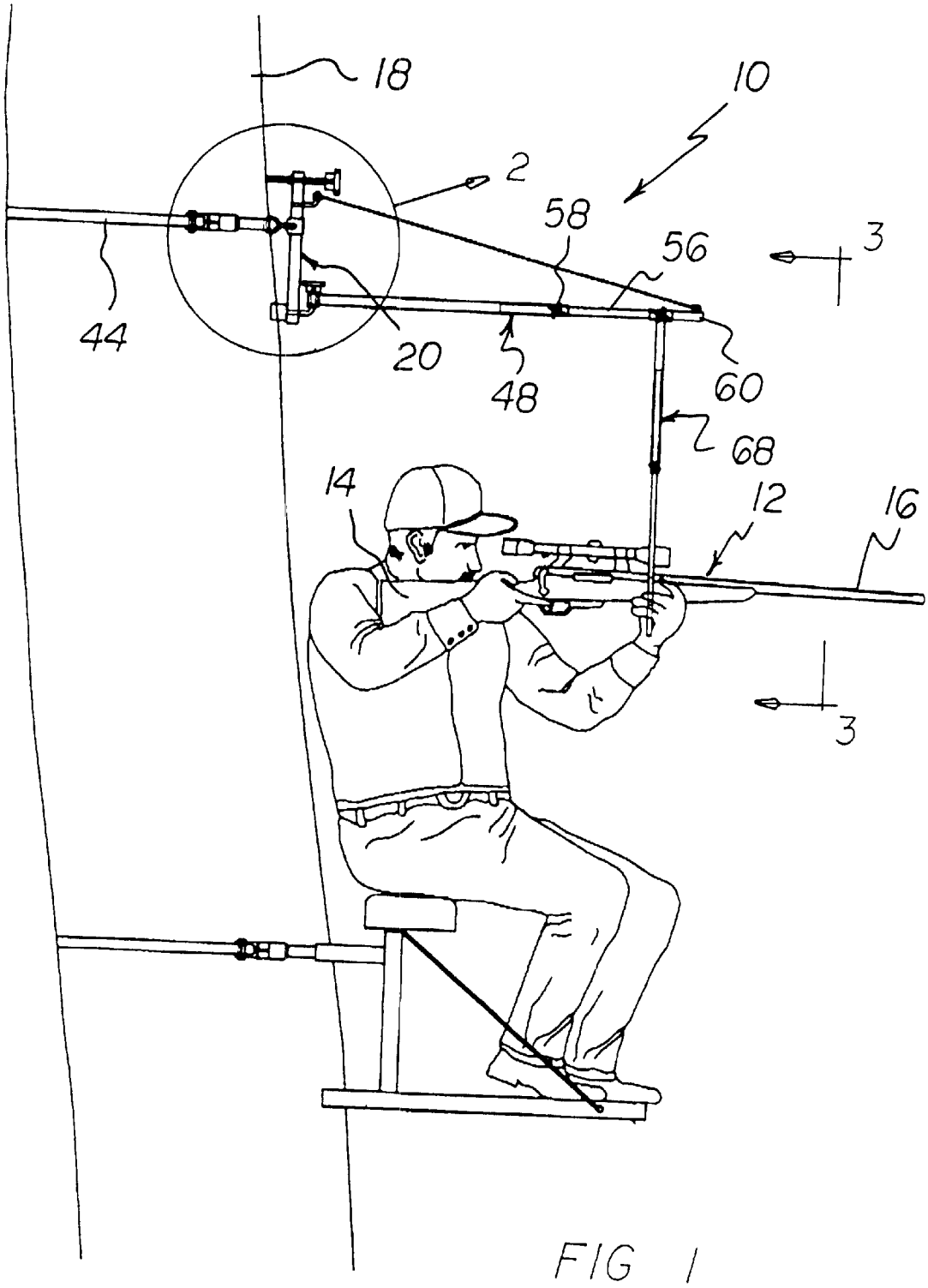
FIG. 1 is a perspective view of the tree stand rest system constructed in accordance with the principles of the present invention.
Figure 2:
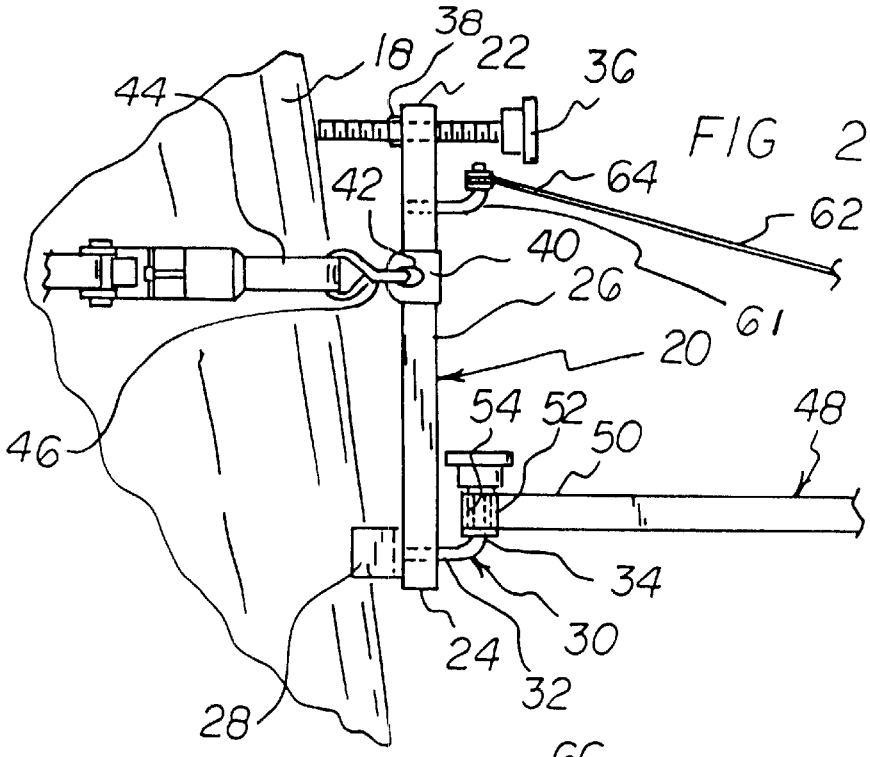
FIG. 2 is an enlarged side elevational view taken at circle 2 of FIG. 1.
Figure 3:
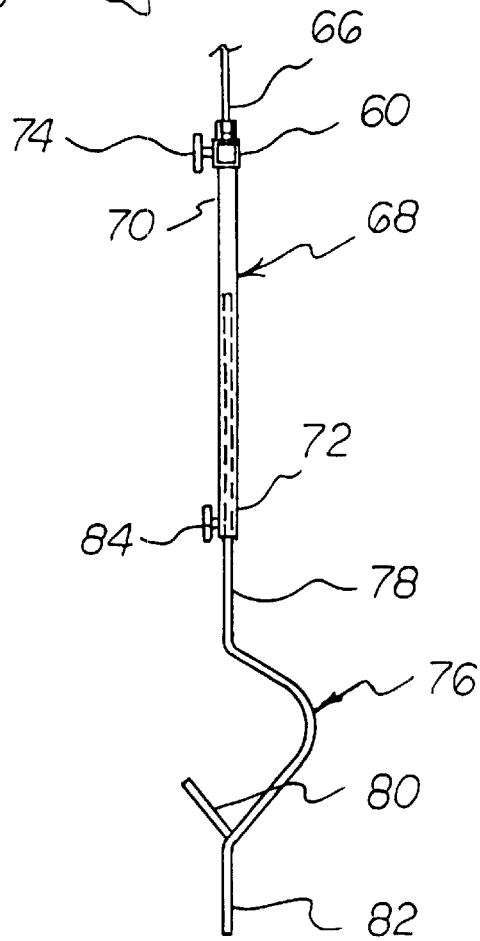
FIG. 3 is a front elevational view taken along line 3—3 of FIG. 1.

With reference now to the drawings, and in particular to FIG. 1 thereof, the preferred embodiment of the new and improved tree stand resting system embodying the principles and concepts of the present invention and generally designated by the reference numeral 10 will be described.

The present invention, the tree stand resting system 10 is comprised of a plurality of components. Such components in their broadest context include a gun, a tree, a mounting bracket, a strap, a pivot arm, a cylindrical support leg and a cradle. Such components are individually configured and correlated with respect to each other so as to attain the desired objective.

First provided is a gun 12. The gun has a stock 14 and a barrel 16. A tree 18 is adapted to hold a tree stand at a first height.

A mounting bracket 20 is provided. The mounting bracket is coupled to the tree at a second height. The second height is greater than the first height. The mounting bracket has a top end 22 and a bottom end 24. A middle portion 26 is provided between the top and bottom ends. The middle portion of the mounting bracket has a strap attachment ring 40. The ring has an aperture 42. The bottom end has tree stand-offs 28. The tree stand-offs are adapted to rest against the tree. The tree stand-offs further have a pivot arm axle 30. The axle has a horizontal portion 32 and a vertical portion 34. The lower extent of the vertical portion includes a support shelf for the pivot arm bushing. The top end has a tree leveling screw 36. The tree leveling screw is adapted to be adjusted to various pitches of the top end. A threaded hub 38 is provided.

A nylon strap 44 is provided next. The strap is coupled around the tree at the second height. The strap further has a hook 46. The hook has a first end. The first end is coupled to the strap. The hook also has a second end. The second end is coupled into the strap attachment ring.

Next, a cylindrical telescoping pivot arm 48 is provided. The pivot arm extends generally horizontally. The pivot arms has a first portion 50. The first portion has a vertical cylindrical pivotable end 52. The pivotable end is rotatably coupled to the horizontal portion of the pivot arm axle with a bushing 54 and an associated pivot arm tensioning knob threadedly coupled there above. The pivot arm tension adjustment knob is used to apply preassure to the pivot arm bushing. By applying varied amounts of pressure, the pivot arm can be adjusted to a desired rate at which the arm pivots. Additionally, constant pressure can be applied thereby placing the pivot arm in a fixed position. This is very important, particularly, when utilizing the bow holder feature while hunting. The pivot arm has a second portion 56. The second portion adjustably telescopes within the first portion and is held in place with a first tightening knob 58. The second portion of the pivot arm has a distal end 60.

Also provided is a pivot arm support cable 62. The pivot arm support cable has a tree end 64. The tree end is coupled to a pivot arm support cable axle 61 of the mounting bracket. The pivot arm support cable axle has a horizontal extent coupled to the mounting bracket and an upwardly directed vertical extent for receiving a loop in the adjacent end of the cable. Above the loop is a pivot arm support cable trailing bushing. Beneath the loop is a support shelf for the trailing bushing. A pivot arm end 66 coupled to the distal end of the pivot arm is adapted to give the pivot arm horizontal support.

Further provided is a cylindrical support leg 68. The support leg extends downward vertically with a top 70 and a bottom 72. The cylindrical support leg is slidably positionable on the second portion of the pivot arm. The support leg is adapted to be held in place by a second tightening knob 74, the pivot arm tension knob.

Provided last is a gun cradle 76. The gun cradle has an upper vertical extent 78, a hooked portion 80 and a lower handle extent 82. The upper vertical extent is adapted to telescope into the bottom end of the support leg and is adjusted to a proper height and held in place with a third tightening knob 84. The hooked portion is adapted to receive the stock of the gun for resting purposes. Note is taken that the gun cradles are designed to place the gun directly beneath the center of gravity of the cylindrical support legs. Being mounted directly beneath the center of gravity is very important to the performance of the rest.

Figure 4:
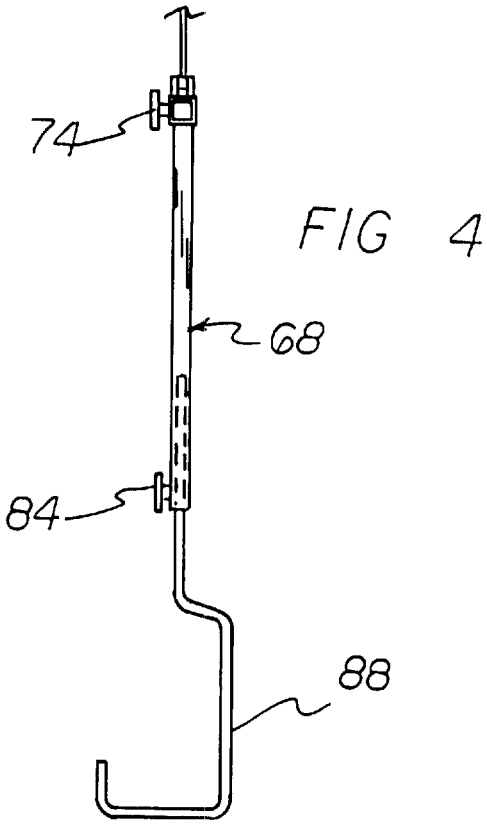
FIG. 4 is a front elevational view similar to FIG. 3 but illustrating a support configuration adapted for supporting a bow.

In an alternate embodiment of the present invention in shown in FIG. 4. In the embodiment, the cradle of the system has an upper vertical extent, a hooked portion and a lower handle extent. The upper vertical extent is adapted to telescope into a bottom end of the support leg. The upper vertical extent is adjustable to a proper height and held in place with a tightening knob. In this embodiment, the hooked portion 88 is U-shaped to receive a bow for hunting purposes. The bow holder "hook" can be configured for any position within 360 degrees. This allows the hunter to place his/her bow at the desired position needed and not a fixed position as with the prior art inventions. Also, the bow hook adjusts vertically to the desired height of the shooter.

In another alternate embodiment, the cradle of the system has an upper vertical extent, a hooked portion and a lower handle extent. Note FIGS. 5 and 6. The upper vertical extent is adapted to telescope into a bottom end of the support leg and is adjusted to a proper height and held in place with a tightening knob. In this embodiment, the hooked portion 92 is L-shaped to receive a camera for shooting purposes.

Figure 7:
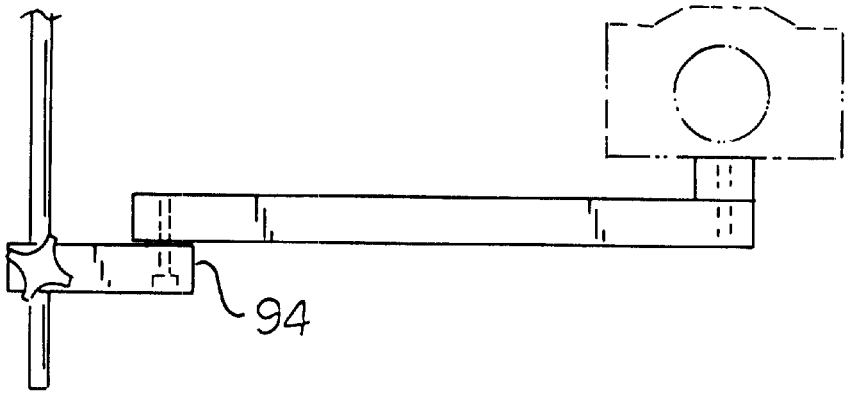
FIG. 7 is a side elevational view similar to FIG. 6 but illustrating the alternate embodiment of the invention with extended adjustability.

FIG. 7 is a further embodiment employing a support 94 for a camera. The support has a supplemental pivot point at its center to extend the utility of the system. Note that the gun cradles, bow holders, and camera brackets have the ability to be adjusted for both right or left handed shooters.

Figure 5:
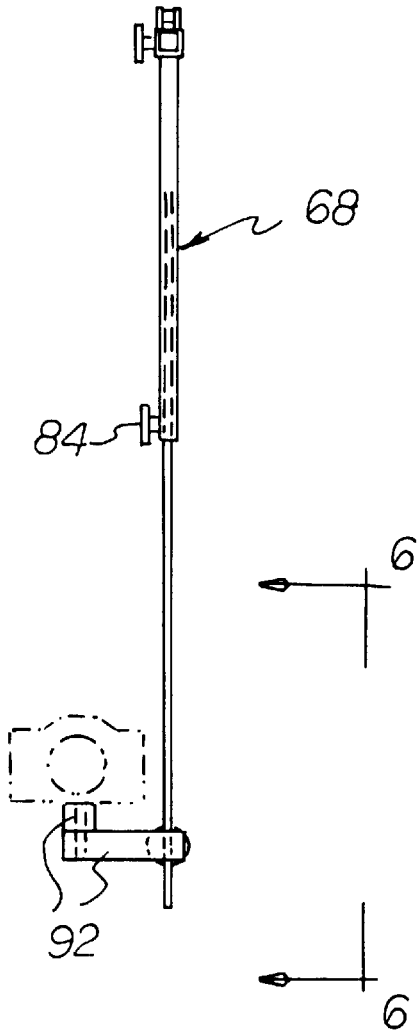
FIG. 5 is a front elevational view similar to FIG. 3 but illustrating a support configuration adapted for supporting a camera.
Figure 6:
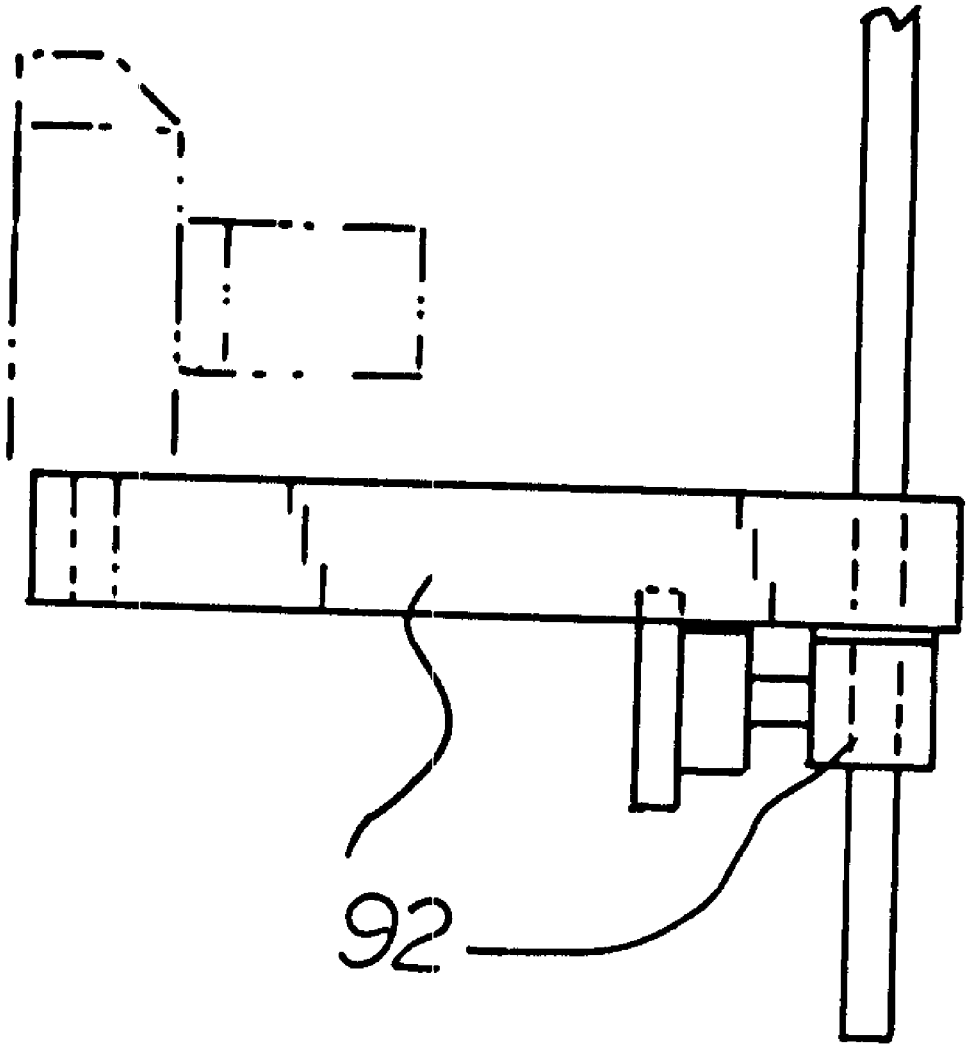
FIG. 6 is a side elevational view taken along line 6—6 of FIG. 5.
Figure 8:
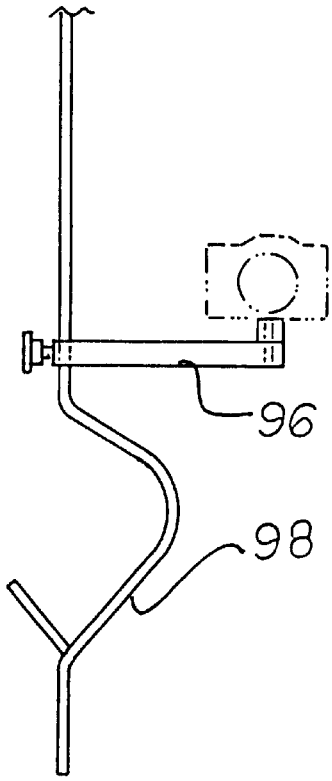
FIG. 8 is a side elevational view similar to FIGS. 6 and 7 but illustrating another alternate embodiment of the invention for supporting both a camera and a weapon, rifle or bow.

The final embodiment is shown in FIG. 8. In such embodiment there is utilized both a support 96 for a camera and a support 98 for a gun. A rubber coating on the lower portion of the gun cradle and bow holder as well as the camera support is preferably utilized to preclude damage to the gun, bow and camera respectively. Lastly, there are various camera brackets that are used. One is used while hunting. One is used for photography only. The one used for hunting is the 6 inch bracket that is shown in FIG. 5 and is used in conjunction with the gun cradle. Note FIG. 8. Both the camera bracket and the gun cradle are used together to film a hunt. The second camera bracket is shown in FIG. 6. This drawing shows the camera bracket from the side view. A frontal view of another embodiment is seen in FIG. 7. This bracket is used for still and video photography only and not while hunting.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tree stand rest system for providing outdoors men with a pivoting and leveling, above the head mounted rest for weapons and the like comprising, in combination:

a gun having a stock and a barrel;

a tree adapted to hold a tree stand at a first height;

a mounting bracket coupled to the tree at a second height such that the second height is greater than the first height, the mounting bracket having a top end and a bottom end and a middle portion there between, the middle portion having a strap attachment ring with an aperture, the bottom end having tree stand-offs adapted to rest against the tree and having a pivot arm axle with the axle having a horizontal portion and a vertical portion, the top end having a tree leveling screw adapted to be adjusted to various pitches of the top end and further having a pivot arm support cable axle extending from the middle portion of the mounting bracket;

a nylon strap coupled around the tree at the second height, the strap further having a hook having a first end coupled to the strap and a second end coupled into the strap attachment ring;

a cylindrical telescoping pivot arm extending generally horizontally and having a first portion with a vertical cylindrical pivotable end rotatably coupled to the horizontal portion of the pivot arm axle with a bushing there between, the pivot arm having a second portion adjustably telescoping within the first portion and held in place with first tightening knob, the second portion of the pivot arm having a distal end;

a pivot arm support cable having a tree end coupled to the pivot arm support cable axle of the mounting bracket and a pivot arm end coupled to the distal end of the pivot arm adapted to give the pivot arm horizontal support;

a cylindrical support leg extending vertically downward with a top and a bottom, the cylindrical support leg being slidably positionable on the second portion of the pivot arm and adapted to be held in place by a second tightening knob; and a gun cradle having an upper vertical extent, a hooked portion and a lower handle extent, the upper vertical extent being adapted to telescope into the bottom end of the support leg and adjusted to a proper height and held in place with a third tightening knob, the hooked portion being adapted to receive the stock of the gun for resting purposes.

2. A tree stand rest system comprising:

a gun;

a tree;

a mounting bracket couplable to the tree with a top end and a bottom end and a middle portion there between, the bottom end having tree stand-offs adapted to rest against the tree and having a pivot arm axle, the top end having a tree leveling screw adapted to be adjusted to various pitches of the top, the middle portion having a strap attachment ring with an aperture;

a strap around the tree with a hook having a first end coupled to the strap and a second end coupled into the strap attachment ring;

a pivot arm extending generally horizontally and with a vertical cylindrical pivotable end rotatably coupled to a pivot arm axle;

a pivot arm support cable having a tree end coupled to the mounting bracket and a pivot arm end coupled to the distal end of the pivot arm;

a cylindrical support leg extending vertically downward; and a cradle formed in the support leg.

3. The system as set forth in claim 2 wherein the cradle has an upper vertical extent, a hooked portion and a lower handle extent, the upper vertical extent being adapted to telescope into a bottom end of the support leg and adjusted to a proper height and held in place with a tightening knob, the hooked portion being adapted to receive a stock of the gun for resting purposes.

4. The system as set forth in claim 2 wherein the cradle has an upper vertical extent, a hooked portion and a lower handle extent, the upper vertical extent being adapted to telescope into a bottom end of the support leg and adjusted to a proper height and held in place with a tightening knob, the hooked portion being U-shaped to receive a bow for hunting purposes.

5. The system as set forth in claim 2 wherein the cradle has an upper vertical extent, a hooked portion and a lower handle extent, the upper vertical extent being adapted to telescope into a bottom end of the support leg and adjusted to a proper height and held in place with a tightening knob, the hooked portion being L-shaped to receive a camera for shooting purposes.

* * * * *